United States Patent [19]

Skrabis et al.

[11] Patent Number: 4,538,391

[45] Date of Patent: Sep. 3, 1985

[54] METAL BUILDING PANELS FOR WALL APPLICATIONS

[75] Inventors: Thomas S. Skrabis, Lemont; Martin D. Jahn, Riverside, both of Ill.

[73] Assignee: Chicago Metallic Corporation, Chicago, Ill.

[21] Appl. No.: 542,434

[22] Filed: Oct. 17, 1983

Related U.S. Application Data

[63] Continuation of Ser. No. 287,132, Jul. 27, 1981, abandoned.

[51] Int. Cl.[3] ..... E04B 2/56

[52] U.S. Cl. ..... 52/478; 52/489; 52/520; 52/522; 52/529

[58] Field of Search ..... 52/478, 483, 485, 489, 52/511, 519, 520, 522, 530, 545, 578, 763, 528, 529

[56] References Cited

U.S. PATENT DOCUMENTS

| | | | |
|---|---|---|---|
| 154,973 | 9/1874 | Wiles | 52/530 |
| 1,072,825 | 9/1913 | Clemmer . | |
| 1,297,591 | 3/1919 | Prescott | 52/522 |
| 1,997,939 | 4/1935 | Loucks | 52/483 |
| 2,765,887 | 10/1956 | Horowitz | 52/522 X |
| 2,820,535 | 1/1958 | Hutchison | 52/520 |
| 2,979,789 | 4/1961 | LaPerouse | 52/482 X |
| 3,131,513 | 5/1964 | Grigas et al. | 52/530 X |
| 3,135,070 | 6/1964 | Waring et al. . | |
| 3,209,503 | 10/1965 | Mostoller . | |
| 3,236,932 | 2/1966 | Grigas et al. | 52/478 |
| 3,253,376 | 5/1966 | Straus . | |
| 3,269,075 | 8/1966 | Marini et al. | 52/522 |
| 3,312,028 | 4/1967 | Schroyer . | |
| 3,323,269 | 6/1967 | Widdowson . | |
| 3,347,001 | 10/1967 | Cosden | 52/522 X |
| 3,388,518 | 6/1968 | Scott . | |
| 3,394,520 | 7/1968 | Skelton, Jr. . | |
| 3,394,524 | 7/1968 | Howarth | 52/529 |
| 3,402,526 | 9/1968 | Baxter | 52/522 X |
| 3,462,906 | 8/1969 | Schroyer | 52/483 X |
| 3,495,363 | 2/1970 | Johnson . | |
| 3,511,011 | 5/1970 | Straus | 52/489 X |
| 3,512,222 | 5/1970 | Tinnerman | 52/520 |
| 3,524,292 | 8/1970 | Bottom | 52/522 |
| 3,555,758 | 1/1971 | Schroter | 52/478 X |
| 3,606,720 | 9/1971 | Cookson | 52/478 X |
| 3,678,642 | 7/1972 | Scott | 52/588 |
| 3,982,373 | 9/1976 | Wilson et al. | 52/588 |
| 4,043,088 | 8/1977 | Payton | 52/529 X |
| 4,063,396 | 12/1977 | Attaway . | |
| 4,091,588 | 5/1978 | Heirich | 52/522 X |
| 4,114,340 | 9/1978 | Dean et al. | 52/520 |
| 4,213,282 | 7/1980 | Heckelsberg | 52/404 |
| 4,288,958 | 9/1981 | Chalmers et al. | 52/478 |
| 4,295,316 | 10/1981 | Carlson . | |

FOREIGN PATENT DOCUMENTS

| | | | |
|---|---|---|---|
| 275287 | 5/1965 | Australia | 52/520 |
| 571545 | 8/1945 | United Kingdom | 52/520 |

*Primary Examiner*—J. Karl Bell

*Attorney, Agent, or Firm*—Hill, Van Santen, Steadman & Simpson

[57] ABSTRACT

A panel for use in constructing a wall, a frame member used for supporting panels of a wall, and a wall structure which utilizes the frame member and the panels characterized by the edge portions of the panels having interlocking shoulders and catches to enable interlocking the panels together in an assembled relationship and the frame members being metal members having integrally formed clips upstanding from a planar surface for engaging the edge and anchoring the panels on the frame members. The panels may have intermediate channel portions which extend parallel to the parallel edge portions and receive tabs which may be provided with catch means that coact with the shoulders in the intermediate channels for anchoring the panels on the frame members intermediate the edge portion.

21 Claims, 15 Drawing Figures

FIG. 1
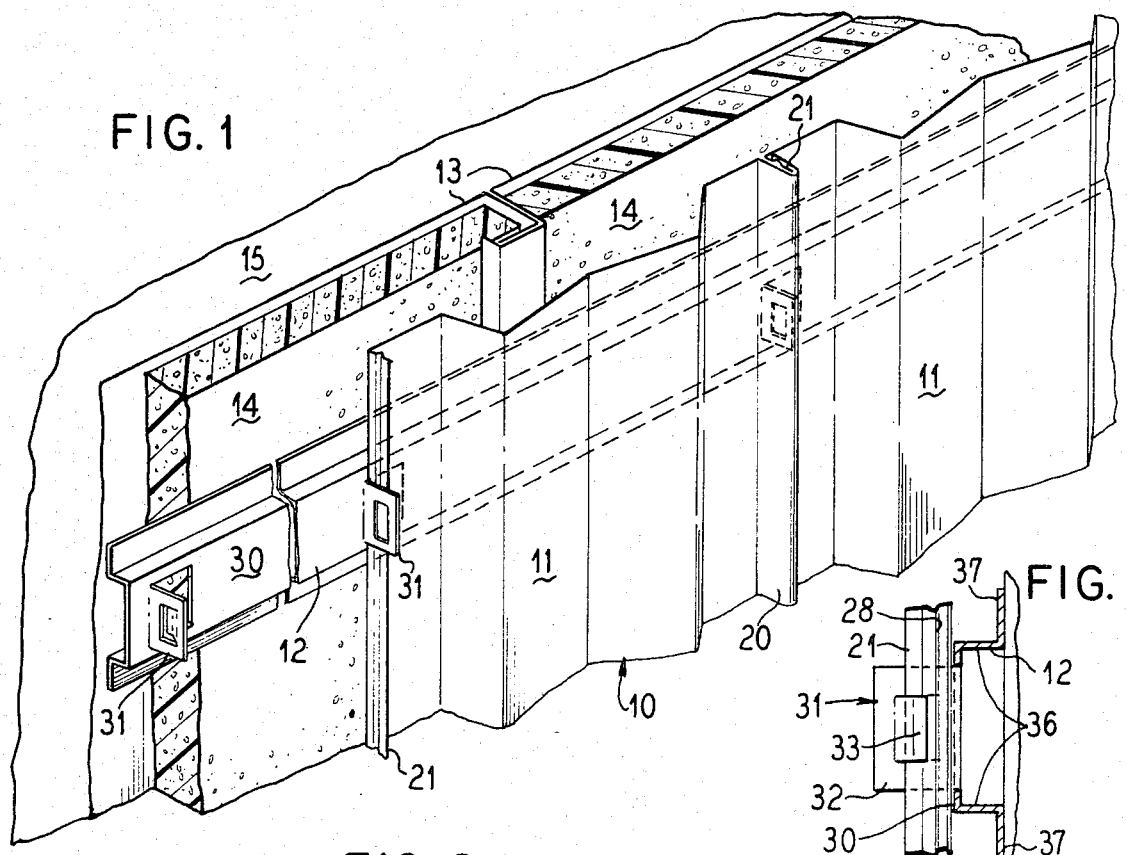
FIG. 3
FIG. 2
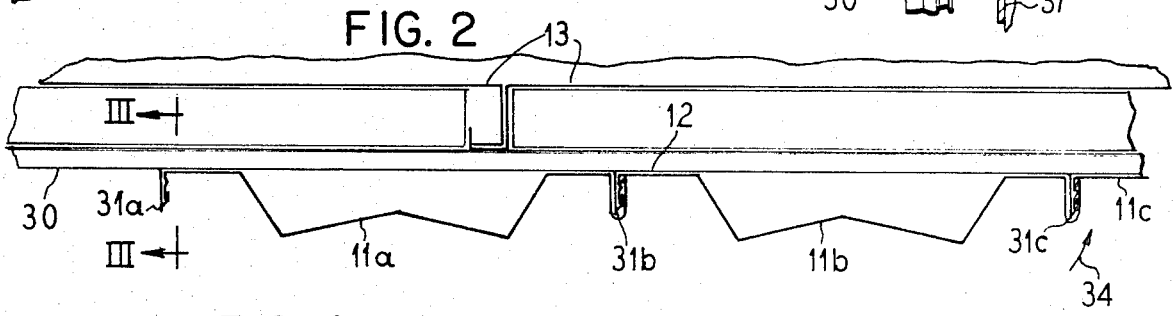
FIG. 4
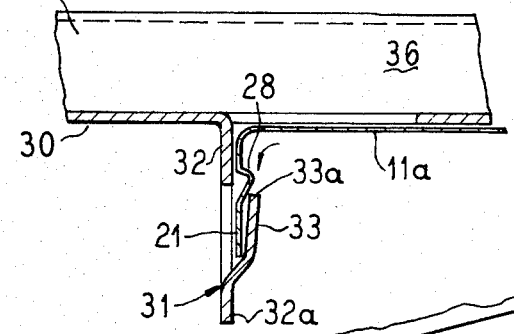
FIG. 5
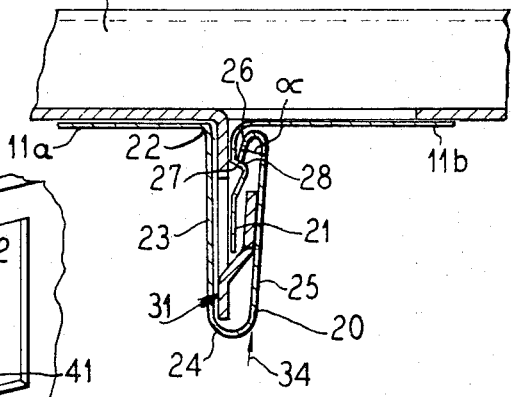
FIG. 6
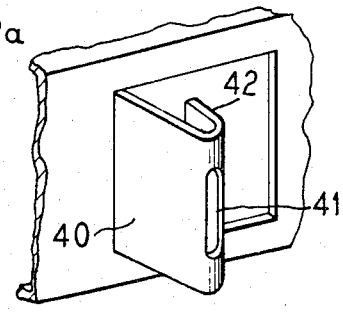

FIG. 7
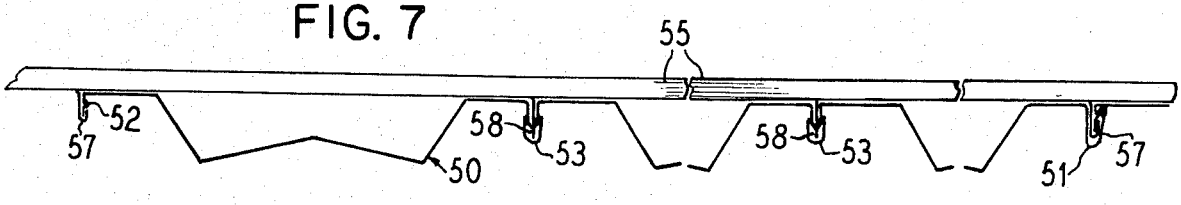
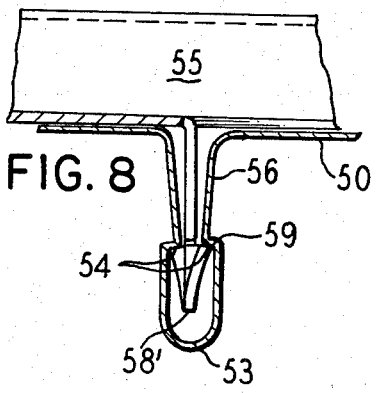
FIG. 8
FIG. 9
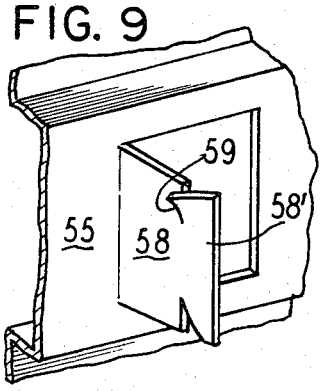
FIG. 10
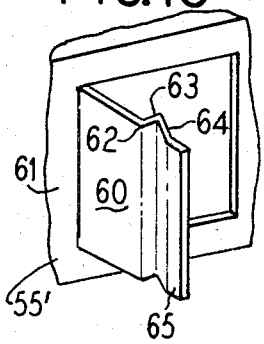
FIG. 11
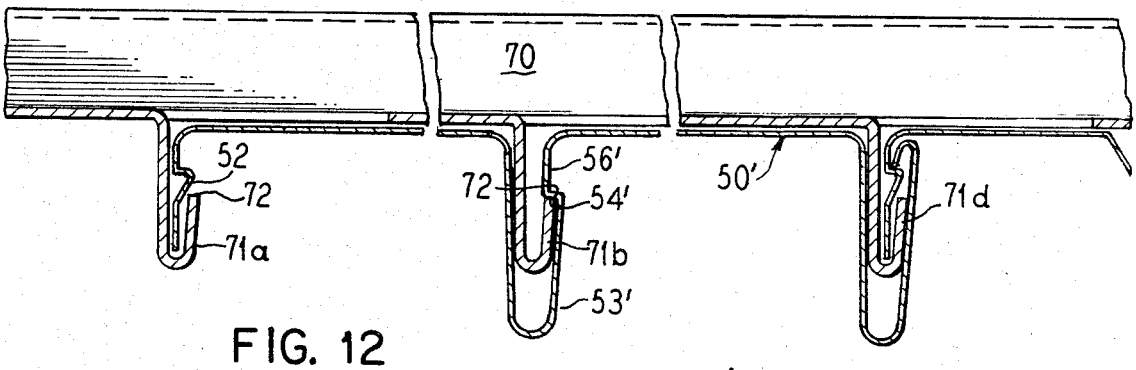
FIG. 12
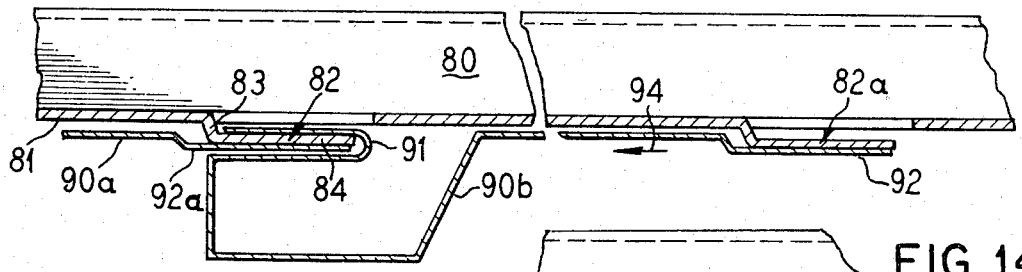
FIG. 13
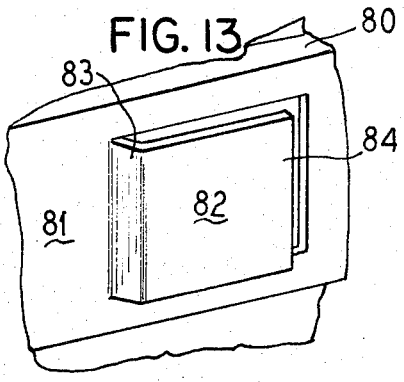
FIG. 14
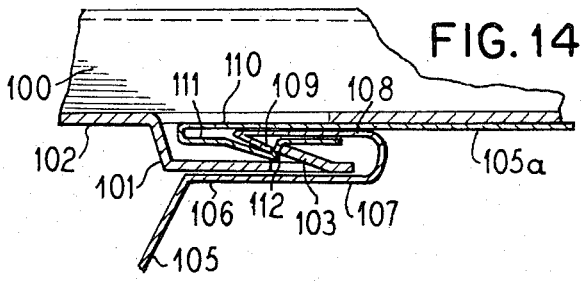
FIG. 15
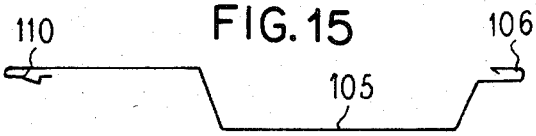

METAL BUILDING PANELS FOR WALL APPLICATIONS

This is a continuation of application Ser. No. 287,132, filed July 27, 1981, now abandoned.

BACKGROUND OF THE INVENTION

The present invention is directed to a wall structure having frame members for supporting panels forming the wall, to the frame member, which have an integral clip member for holding the panels on the frame member, and to the panels which have coacting edge portions which interlock the panels together.

In a building construction utilizing panels either for a roof construction or a sidewall construction, problems have always occurred in connecting adjacent panels in a manner so that there would be no leaking between the adjacent panels and also so that the connection of the panels would not destroy the aesthetic looks for the wall. One proposed solution to these problems is to provide a panel with edge portions which coact to form a connection or joint between adjacent panels and which would hide the mounting means whether they are fasteners such as nails as disclosed in U.S. Pat. Nos. 3,135,070 and 3,495,363 or utilized clips such as disclosed in U.S. Pat. Nos. 3,253,376 and 4,063,396.

It has also been proposed to use connecting edge portions which may include a clip member to anchor the edge of the panel to a frame member, sub-girt or sub-wall such as disclosed in U.S. Pat. Nos. 3,209,503; 3,312,028; 3,323,269; 3,388,518; 3,511,011, 3,678,642 and 4,063,396. In one of the solutions proposed in the above-mentioned patents, after the members are arranged with a clip holding the edge or flange of one panel, the edge of the adjacent panel is deformed over the clip and the flange or edge of the first panel to form the connection (see U.S. Pat. No. 3,312,028). It has also been proposed that after arranging a U-shaped flange of one panel to receive an upstanding flange of the adjacent panel, as shown in U.S. Pat. No. 3,323,269, to use a punch to deform a portion of the U-shaped flange into clinching engagement onto the other flange to form a die clinched or button punched connection between the two flanges. While this die clinch can be used between two flanges, it also can be used between two flanges in which a clip has been inserted. As shown in the above-mentioned Patent No. 3,323,269, the panel may also have one or more channels which are intermediate the side portions and are deformed or clinched onto clips received therein.

Each of these procedures has problems. The assembly of the panels and clips onto the sub-frame, such as the sub-girt, requires utilizing a plurality of tools. For example, the clips must be mounted on the sub-girt and then the panel is assembled onto the clips and subsequently deformed either by the rolling deformer or by the die clinching apparatus such as the button puncher to form an interlocking connection of the panels onto the clips which anchor the panels onto the sub-girt. This has the disadvantage that the worker not only must handle the panels but also operate a plurality of tools which increases the time of erecting the sidewall due to the large number of manipulative assembly steps.

SUMMARY OF THE INVENTION

The present invention is directed to providing a wall structure including a sub-frame and panels having interlocking edge portions which will greatly increase the speed of erection by reducing the number of manipulative steps that are necessary during the erecting of the panels to form a wall or roof.

To accomplish these goals, the invention is directed to a wall structure comprising at least two metal sub-frame members or sub-girts which extend parallel to each other and have a plane surface with integral tabs cut and raised therefrom at selected distances to form integral clips for use in securing and anchoring panels onto the members; and metal panels, which have parallel extending first and second edge portions which coact with edge portions of adjacent panels to interlock the panels together, the first edge portion having a reversely bent flange with a U-shape cross-section with a free end or edge of the flange having means forming a catch, said means being a reversely bent flap portion, the second edge portion being receivable in the reversely bent flange portion of the first edge portion of the adjacent panel and having an integral means forming a shoulder for engagement with the means forming the catch to interlock the flanges together, said first edge portion being preferably anchored to the sub-girt by the integral clip thereon.

The first edge portion may extend upwardly from the basic plane of the panel with the opening of the reversely bent flange extending toward the sub-frame and the second edge portion is a single upright flange having the integrally formed shoulder. However, these two edge portions instead of extending at substantially right angles to the plane of the panel may also both be reversely bent flanges having a U-shaped cross-section which flanges extend along the plane of the panel, and open toward the center of the panel. In this connection the free edge of each flange is received in the U-shaped portion of the flange of the adjacent panel.

In addition, to the interlocking edge portions, each of the panels may have intermediate spaced channels or channel portions which receive intermediately spaced integral tabs or clips of the sub-girt or frame member. These intermediate channels may also be provided with shoulders, which are engaged on catches or integrally formed shoulders on the intermediate clips to form a locking attachment or anchor which is intermediate the two edge portions for each of the panels.

While it is preferred and desirable that both the sub-frame or sub-girt with the integral clips and the panels with the interlocking edge portions are utilized together, it is possible to utilize the panels of the present invention with previously known sub-girts which are provided with detachable clips. In a similar manner, it is possible to use the sub-girts or frame members having the integrally formed clips with the previously known panels which had the connecting form by a subsequent deforming of the assembled edge portions such as by a die clinching or button punching.

In erecting the wall, the various frame members or sub-girts are mounted to extend parallel to each other with the clips of the frame members being aligned. Then each panel is assembled on the aligned parallel frame members in a manner which depends on the exact structure of the edge portions. For example, if the clips are designed to engage the second edge portion, a first panel is assembled with the second edge portion engaged by the clips. Subsequently the next adjacent panel is assembled with the second portion inserted in the clips and then is rotated until the first edge portion receives the second edge portion of the adjacent panel and the catch means is engaged on the shoulder to lock the two panels together. This is continued until the end of the wall structure is reached at which time a finishing member is required.

BRIEF DESCRIPTION OF THE DRAWINGS

FIG. 1 is a perspective view of a vertical wall constructed in accordance with the present invention;

FIG. 2 is a top view of the wall illustrated in FIG. 1;

FIG. 3 is a partial cross-sectional view taken along the lines III—III of FIG. 2;

FIG. 4 is an enlarged cross-sectional view with portions in elevation of an edge portion of the panel engaged in the clip of a sub-girt of the present invention;

FIG. 5 is a cross-sectional view with portions in elevation of the joint between the two edge portions in accordance with the invention;

FIG. 6 is a perspective view of an embodiment of the clip in accordance with the present invention;

FIG. 7 is a top view of a wall with an embodiment of the panel of the present invention;

FIG. 8 is an enlarged cross-sectional view with portions in elevation of an intermediate clip arrangement utilized in FIG. 7;

FIG. 9 is a perspective view of an embodiment of the intermediate clip;

FIG. 10 is a perspective view of another embodiment of the intermediate clip;

FIG. 11 is a cross-sectional view with portions in elevation of an embodiment of the wall of FIG. 7 utilizing the same clip for both the edge portions and the intermediate channel portions of the panel;

FIG. 12 is a cross-sectional view with portions in elevation of another embodiment of a clip utilized for anchoring a different type of commercially known panels;

FIG. 13 is a perspective view of the clip of FIG. 12;

FIG. 14 is a cross-sectional view with portions in elevation of an embodiment of the clip utilized with an embodiment of the commercially known panel modified in accordance with the present invention; and FIG. 15 is a profile view of the panel used with the structure of FIG. 14.

DESCRIPTION OF THE PREFERRED EMBODIMENTS

The principles of the present invention are particularly useful in a wall structure generally indicated at 10 in FIG. 1. The wall structure 10 consists of outer metal panels 11 which are mounted on metal sub-frame members or sub-girts 12. As illustrated, the sub-frame or sub-girt members 12 are secured or mounted on a sub-wall structure formed by metal panels 13, which may include insulating material 14 and are in turn mounted on a sub-wall such as 15. It should be noted, that the wall structure 10 of the present invention is composed of metal panels 11 and the metal sub-girts 12. The sub-girts 12 can be mounted on any sub-wall whether it is a panel 13, masonary wall, or either metal or wooden studs. It is also to be considered, that the wall structure 10 of the present invention which is illustrated in FIG. 1 as a vertical wall with vertically extending panels 11 on the exterior of the building could also be an interior wall or could also form a roof. It is also noted that the sub-girts 12 could be mounted to extend vertically instead of horizontally as illustrated and then the panels 11 would be mounted on the sub-girts to extend horizontally.

As illustrated in FIG. 1, each of the wall panels 11 have first edge portions 20 and second edge portions 21 which extend parallel to each other and at substantially right angles to a plane of the panel 11. As illustrated in FIG. 5, a first edge portion 20 of a panel 11*a* coacts with a second edge portion 21 of an adjacent panel 11*b* to interlock the two adjacent panels 11*a* and 11*b* together. In the design of the panel 11, each of the first edge portions 20 has a bend 22 with an outwardly extending flange or leg 23 which extends approximately at right angles to the main portion of the panel 11. The flange 23 terminates in a reversed bend 24 having a leg 25 which coacts with the leg 23 to form a U-shaped cross-section. The leg 25 at a free end has a reversed bend providing a flap or tab 26 which has a terminal or boundary edge 27 and acts as means for forming a catch. The flap 26 extends at an angle $\alpha$ to the leg 25 and an angle $\alpha$ of about 30° has been provided a satisfactory catch.

The other or second edge portion 21 as best illustrated in FIG. 4 is a leg or flange of a single thickness with a free edge and has an integral shoulder 28 which is formed by a fold or bent crease in the flange which continuous shoulder extends along the entire length of the panel and inward of the free edge of the flange. Thus, when the U-shaped flange formed by the first wall portion 20 is snaped over the upstanding flange 21, the edge 27 of the catch formed by the flap 26 engages the shoulder 28 to interlock the two panels together. As illustrated, the shoulder 28 and the edge 27 are both spaced a given distance from the exterior surface of the panels 11.

Each of the panels 11 is supported on the sub-girt 12, which has a planar surface 30 from which integral clips 31 have been raised at predetermined intervals. As best illustrated in FIG. 4, each clip 31 has a tab 32 which is cut and bent to extend at right angels to the planar surface 30 of the member 12 and each tab 32 has a second portion or smaller tab 33 which was cut and deformed or offset to form a clip for receiving the edge of the flange forming the second edge portion 21. The sub-girt 12 is a channel member with the portion forming the planar surface 30 being the bight of a channel which has short legs such as 36 extending to planar flanges 37 (best shown in FIG. 3). As mentioned hereinabove, each of the clips such as 31 is formed by die cutting the bight portion with the die cutting causing the lifting out and formation of the tabs 32 and 33.

To construct the wall 10, a plurality of the sub-girts 12 are secured on the stubs or the inner wall panels 13 to extend parallel to each other with each of the clips 31 extending in a line. After securing the sub-girts 12, the panels 11 can be assembled in the following order on the girts to extend at right angles thereto. A first panel 11*c* has its second edge portion 21 inserted into the clip 31*c* of FIG. 2. Next the panel 11*b* has its second edge portion 21 inserted into the clips 31*b* and the panel is rotated in a counter clockwise direction until the U-shaped flange of the first edge portion 20 receives the clip 31*c* and the second edge portion of the panel 11*c*. The panel 11*b* is still rotated in the direction of arrow 34 until the edge 27 of catch means 26 is engaged on the shoulder 38. Next, the panel 11*a* has the second edge portion 21 inserted in the clip 31*a* as best illustrated in FIGS. 2 and 3 and then it is rotated so that the first edge portion 20 is received over the second edge portion 21 of the adjacent panel 11*b* and until the catch means of the first portion 20 is received on the shoulder 28 of the second edge portion 21 of the panel 11*b* to interlock the two panels together. This can be repeated continually until the entire wall or roof is completed. It is noted that when you reach the end of the wall, a specially designed edge strip or cover will be provided.

In this construction, it is noted that each of the panels 11*a*, 11*b* and 11*c* are secured on the sub-girt 12 without requiring any tools for installing the clips such as 31 and the edge portions of the adjacent panels are interlocked together without requiring any deformation of the panels such as by button punching as used in the prior art. It is noted that in the event a panel needs to be removed, such as the panel 11*b*, a tool can be inserted to disengage the catch means of the first edge portion of the panel 11*a* and also of the first edge portion of the panel 11*b*. After disengaging the first edge portion of the panel 11*b*, the panel can be rotated in a clockwise direction as illustrated in FIG. 2 to a position where the second edge portion can be disengaged from the clips such as 31*b*.

An embodiment of the integral clip is illustrated in FIG. 6. In this embodiment, the clip 40 has an upstanding portion with a slot 41 spaced inwardly from a free end 42. The free end 42 is then bent to form the hook-like clip which has a profile best illustrated in FIG. 11. If desired, the clip 40 can be formed as a simple planar tab extending upwardly from the sub-girt and, is bent at the slot 41 into the hook shape by the persons erecting the wall. In the embodiments illustrated in FIG. 1, the sub-girts 12 are only provided with clips that coact with the edge portions of the respective panel for securing each of the panels 11 onto the sub-girt. These panels have a basic width such as 12 inches and the clips are provided on twelve inch centers.

In FIG. 7, a wider panel such as the thirty-six inch panel is illustrated and is generally indicated at 50. This wider panel 50 has a first edge portion 51 and a second edge portion 52 which portions extend parallel to each other and the panel is provided with two intermediate channel portions 53, 53. The two intermediate channel portions 53, 53 extend parallel to the edge portions 51 and 52 and subdivide the panel into three parallel extending twelve inch wide sections. Each of the channel portions 53 is provided with a pair of internal shoulders such as 54, 54 as best illustrated in FIG. 8 which are spaced above a planar surface of a sub-girt 55 by a narrow throat portion 56.

The panel 50 is mounted on sub-girts such as 55 which has the integral clips. At a position for engaging each of the second edge portions 52, the sub-girt 55 will have clips 57 which will have a shape or configuration either similar to the clip 31 of FIG. 1 or 40 of FIG. 6. These clips 57 are spaced apart at an interval or distance of the width of each of the panels and thus are on approximately a thirty-six inch center. Between clips 57, the girt 55 will have intermediate clips or tabs 58 which are received in the intermediate channel portion 53. As illustrated, in FIG. 9, the intermediate clip 58 has a tab shape with a cut or slot extending inward from each lateral edge. Adjacent each of the slots, a portion of the edge of the slot is bent to form a catch 59 which is engaged on the internal shoulder 54 of the intermediate channel portions 53. Beyond the slot, the clip 58 has a planar portion 58' which acts to help guide the clip into the throat 56 of the channel portion 53.

Instead of forming the intermediate tab 58 with the configuration illustrated in FIG. 9, a modification is illustrated by the tab 60 in FIG. 10. At a distance from the planar surface 61 of the sub-girt 55' the tab 60 has a right angle bend 62 to form a shoulder 63 which has another bend to form a tapering leg 64 that goes into a planar projection such as 65. The planar projection such as 65 helps while inserting the tabs such as 60 into the throat of the intermediate channel portions 53 and the shoulder such as 63 will engage one of the internal shoulders 54 of the channel portion 53.

A modification of the panels 50, as illustrated and indicated at 50' in FIG. 11. In this embodiment, the intermediate channel portions or channels 53' have a smooth surface on one side and are provided with only a single internal shoulder 54' which is spaced by a throat 56' from the plane of the panel 50'. The channel 53' could receive the tab such as 60 (FIG. 10). As illustrated in FIG. 11, the panel 50' is mounted on a sub-girt 70 which has a plurality of integral upstanding clips 71 which are all of the same structure and have a hook shape similar to clip 40 of FIG. 6 with a free edge 72. As illustrated the clip 71*a* engages a second edge portion 52 of the panel 50' and the clip 71*d* engaging the second edge portion of the adjacent panel. The intermediate clips between the clip 71*a* and 71*d* such as the clips 71*b* are received in the intermediate channel such as 53' with the free edge 72 being engaged on the shoulder 54' to hold the panel adjacent the intermediate section onto the sub-girt such as 70.

The panel 50' could be used with the sub-girts 12 with the clips 31. The outer end 32*a* of the clip 31 will aid in guiding the clip into the throat of the channel portion 53' until an edge 33*a* of the small tab 33 becomes engaged in the shoulder 54'.

When installing the panels such as 50 and 50', they are installed in the same manner as the panel 11 with the exception that after the second edge portion such as 52 has been engaged on a clip such as 57, the intermediate channels 53 and the first edge portion 51 are then moved to a point where their respective shoulders 54 and catches are engaged on the respective catch means 59 of clip 58 and shoulders of the portion 52.

While the preferred structure utilizes both the sub-girts or frame members having integral clips and the panels which are provided with the interlocking edge portions and if necessary also the intermediate channels such as 53, it is possible to use the panels such as 11 with commercially available clips which are detachably mounted on a standard sub-girt. By utilizing standard sub-girts and mounting clips thereon, some of the advantages, which are the of elimination of some of the manipulative assembly steps which are required to mount the clips on the girt, are lost.

It is also possible to use the sub-girts with the integral clips with panels which do not have the inventive interlocking edge portions and which are interlocked after the assembled of the U-shaped edge portion of the first edge portion on the upstanding flange of the second edge portion by being crimped such as by using a button punch as known in the prior art references. Again, the advantages of reducing the number of manipulative steps, which would be necessary in erecting the panels, would be lost due to the necessary manipulative steps, which are required to crimp the flanges together to form the interlock.

In FIGS. 12 and 13, an embodiemnt of the integral clip on a metal sub-member or sub-girt 80 is illustrated. The sub-girt 80 has a channel configuration and has a planar surface 81 in which integral clips 82 have been cut and deformed or displaced from the plane of the surface 81. The clip 82 contrary to the previously described clips have only a short upright portion 83 with the major portion 84 extending parallel to the planar surface 81 of the girt 80. As illustrated in FIG. 12, these clips 82 are used for mounting a known style of panel 90 which has a U-shaped channel 91 that receives an edge portion 92. To install the panels such as 90, a first panel 90*a* is assembled with its edge portion 92*a* engaged or resting on the clip 82. Then the next pane 90*b* has the U-shaped portion 91 moved in a direction such as the arrow 94 to receive both the clip 82 and the edge portion 92*a*. When it is in position, then its free edge portion 92 is then laying on the next adjacent clip such as 82*a*. Then the next member is slid on as illustrated.

Instead of utilizing panels that are commercially known panels, it is also possible to construct the clip illustrated in FIG. 14. In this arrangement, the girt 100 has an integral clip 101 which extends from a planar surface 102 and has a profile similar to that of the clip 82 of FIG. 12. However, the clip 101 also has a small tab or portion 103 deformed therefrom. As illustrated, the tab 103 is a portion which has been cut and bent from the clip 101 and forms a catch means. The sub-girt 100 is used with a panel 105 (FIG. 15) which on one edge has a first U-shaped edge portion 106 which is formed by a leg 107 that is connected by a reversed bend to an outer free end or leg 108 which in turn terminates in a reversely bent flap 109 (FIG. 14) that forms a catch means. An opposite or second edge portion 110 of the panel 105 is also formed with a U-shaped cross-section with a reversed bend having a free leg 111 provided with an integral shoulder 112. As illustrated in FIG. 15, the two U-shaped edge portions open inwardly toward the center of the panel 105.

The panels 105 can be inserted onto the sub-girts 100 in the following manner. The first panel 105*a* has its second edge portion 110 inserted onto the clip 101 with the integral shoulder 112 being arranged by the catch means 103 to prevent its removal. Then the next adjacent panel 105 has its first edge portion 106 and second edge portion slid or moved parallel to the parallel surface of the girt until the second edge portion is received in the next adjacent clip 101 and the free leg 108 having the catch means formed by the flap 109 is received in the U-shaped flange of the second portion 110 of the panel 105*a*. This second panel is moved until the second edge portion engages or catches the clip and the catch means or flap 109 is received and catches on the internal shoulder formed by the portion 112 of leg 111 of the second edge portion 110 of the panel 105*a*.

As mentioned hereinabove, preferably, the panels of the present invention are utilized with the sub-girts of the present invention which means that the person erecting the wall does not need to perform the manipulative steps of mounting or assembling the clips on the sub-girt, assembling the panels on the clips and then subsequently crimping or button punching the assembled edge portions to interlock the panels together and secure them on the clips. Also the use of the panels and sub-girts of the present invention together means that no fastener such as screws will be required and either be visible or covered by some portion of the panel. However, the panels of the present invention can be used with conventional clips, which are attached to the subframe member such as the sub-girt; however, the assembly method would require a corresponding additional number of manipulative steps for mounting the various clips on the sub-girt. It is also noted that the sub-girts with the integral clips of the present invention can be used with ordinary panels and would eliminate the manipulative steps of mounting the clips on the sub-girt; however, the ordinary panels would still require either the use of fastener to aid in securing the panel on the sub-girt or the crimping such as by button punching to form the interlocking between the edge portions of adjacent panels.

Although various minor modifications may be suggested by those versed in the art, it should be understood that we wish to embody within the scope of the patent granted hereon, all such modifications as reasonably and properly come within the scope of our contribution to the art.

We claim:

1. A structure having at least two parallel extending frame members and having a plurality of interlocked panels mounted on said frame members and extending transverse thereto, said structure comprising at least two metal frame members, each having a planar surface with tabs cut and raised upright from the planar surface at selected intervals, said tabs forming integral clips for use in securing the panels on said members, said frame members being positioned to extend parallel to each other with the clips being aligned with each other; and a plurality of sheet metal panels, each of said panels having parallel extending first and second edge portions which coact with edge portions of the adjacent panel to interlock the panels together, said first edge portion extending at substantially a right angle from a plane of the panel and having a reversely bent flange with a U-shaped configuration with the free edge of the flange having means for forming a continuous catch, said means for forming a continuous catch being a terminal edge of a reversely bent flap portion at the end of said free edge being bent to extend back into said U-shaped configuration of said flange, the second edge portion having a single second leg portion of a single thickness with a second free edge extending at substantially right angles to the plane of the panel and having integral means comprising a bent crease spaced inward of the second free edge and extending the entire length of the second leg portion for forming a continuous shoulder extending along the length of the panel, said second leg portion of the second edge portion being received and engaged in the clips of the frame members with the clips engaging the second free edge and said second edge portion and clips being received in the first edge portion of the adjacent panel with the first edge portion covering both the second edge portion plus the clips of the frame members as the means for forming a catch engages the shoulder of the second edge portion to form an interlocking connection between adjacent panels so that the clips anchor the two panels at each interlocking connection on the frame member.

2. A structure according to claim 1, wherein each of said upstanding tabs having a second tab cut and bent therefrom to form means for engaging the second free edge of the second edge portion of the panel.

3. A structure according to claim 2, wherein each of the panels has at least one intermediate channel portion with a narrow throat, each channel has a configuration to form at least one internal shoulder inward of said throat, said frame members having an intermediate tab extending upright and being positioned to be received in each of said channel portions, and each of said intermediate tabs has means forming a catch for engaging the shoulder of the intermediate channel portion to form a connection for anchoring the panel intermediate the edge portions onto said frame member.

4. A structure according to claim 3, wherein each of the intermediate tabs has the same configuration as the clips engaging the second edge portion of the panel.

5. A structure according to claim 4, wherein each of the clips has means for guiding the clip as it is inserted into the intermediate channel.

6. A structure according to claim 3, wherein each of the intermediate tabs has a configuration different than the configuration of the clips engaging the second edge portion of the panel.

7. A structure according to claim 6, wherein the intermediate tabs include means for guiding the intermediate tabs into the intermediate channel portion.

8. A structure according to claim 6, wherein the means for forming the catch for each intermediate tab comprises a bent portion of the intermediate tab.

9. A structure according to claim 8, wherein each of the intermediate tabs has a notch extending inward from an edge of the tab and the bent portion of the tab is adjacent the notch.

10. A structure according to claim 8, wherein each of said intermediate channel portions has an internal shoulder on each side of the channel portions and the means for forming a catch for each intermediate tab forms a catch on each side of the intermediate tab for engaging the two shoulders.

11. A structure according to claim 10, wherein the means forming a catch on each side of the intermediate tab includes a notch extending inward from each edge of the tab with a portion of the tab above each notch being bent out of a plane of the tab and in opposite directions.

12. A panel for use in constructing walls and roofs having a pluality of parallel extending panels having edge portion coacting to interlock the panels together, said panel having parallel extending first and second edge portions, said edge portions extending at substantially right angles to a plane of the panel with the first edge portion having a reversely bent flange with a U-shaped configuration opening toward said plane with a free edge of the flange having means for forming a continuous catch extending along the length of the flange, said means for forming a continuous catch being a terminal edge of a reversely bent flap portion of the free edge bent to extend back into said U-shaped configuration of the flange, the second edge portion having a single second leg portion of a single thickness with a second free edge and being adapted to be received in the flange of an adjacent panel, said second leg portion having integral means comprising a bent crease extending the entire length of the panel for forming a continuous shoulder extending along the length of the second edge portion and inward from the second free edge for engagement by the terminal edge of the means forming the continuous catch so that when two adjacent panels are assembled with the first edge portion receiving the second edge portion of the adjacent panel, said shoulder is engaged by said terminal edge to interlock the two panels together.

13. A panel according to claim 12, which includes an intermediate channel portion with a narrow throat extending from the plane of the panel adapted to receive a tab projecting from a sub-frame as the panel is mounted thereon.

14. A panel according to claim 13, wherein the intermediate channel portion has formed therein at least one integral shoulder outward of the throat for receiving a catch means on a clip for anchoring the intermediate portion of the panel to a sub-frame.

15. A panel according to claim 14, wherein said intermediate channel portion has a pair of internal shoulders on opposite sides thereof.

16. In a structure having a plurality of parallel extending panels interconnected at their edges by an interlocking connection, said panels being anchored on frame members by clips engaging an edge of each panel, the improvement comprising each panel being a sheet metal panel having parallel extending first and second edge portions with the first edge portion extending upright at substantially a right angle to a plane of the panel and having a reversely bent flange with a U-shaped configuration opening toward the plane and having a free edge of the flange having means for forming a catch, said means for forming a catch being a terminal edge of a reversely-bent flap portion of the free edge bent to extend back into said U-shaped configuration of the flange, the second edge portion being adapted to be received in the flange of an adjacent panel and having a single second leg portion of a single thickness with a second free edge and extending at substantially a right angle from the plane, said second free edge of the second leg portion being engageable by the clips and the second leg portion having integral means comprising a bent crease spaced inward of the second free edge and extending the entire length of the panel for forming a continuous shoulder extending along the length of the panel for engagement by the means forming the catch so that when two adjacent panels are assembled with the first edge portion receiving the second edge portion of the adjacent panel and clips, said shoulder of the second edge portion is engaged by said means for forming a catch to interlock the two panels together.

17. In a structure according to claim 16, which includes an intermediate channel portion with a narrow throat extending from the plane of the panel adapted to receive a clip projecting from a sub-frame as the panel is mounted thereon.

18. In a structure according to claim 17, wherein the intermediate channel portion has formed therein at least one integral shoulder outward of the throat for receiving a catch means on a clip for anchoring the intermediate portion of the panel of the sub-frame.

19. In a structure according to claim 18, wherein said intermediate channel portion has a pair of internal shoulders on opposite sides thereof.

20. A vertical wall structure having at least two parallel, horizontally extending frame members and having a plurality of interlocked, vertically extending panels mounted on said frame members and extending transverse thereto, said structure comprising at least two metal frame members, each having a planar surface with first tabs cut and raised upright therefrom at selected intervals, said first tabs having second tabs cut and bent from the first tab to form integral clips for use in securing the panels on said members, said frame members being positioned to extend parallel to each other with the clips vertically aligned with each other; and a plurality of sheet metal panels, each of said panels having a planar panel surface with parallel extending first and second edge portions which coact with an edge portion of an adjacent panel to interlock the panels together, said first edge portion having a reversely bent flange with a U-shaped configuration with a first leg portion with a free edge, said first leg portion extending at right angles to the planar panel surface, the second edge portion having a second leg portion with a free edge extending at right angles to the planar panel surface, one of the first and second leg portions having means for forming a catch, said means for forming a catch being a terminal edge of a reversely bent flap portion at the end of said free edge of said one leg portion and extending along the entire length of the panel, the other of the first and second leg portions having integral means comprising a bent crease extending along the entire length of the panel and inward of the free edge for forming a continuous shoulder extending the length of the panel, the free edge of said other leg portion being received and engaged by the clips of the frame members, said second edge portion being received in the first edge portion of the adjacent panel with the panels covering both the second edge portion plus the clips of the frame members as the means for forming a catch engages the shoulder to form an interlocking connection between adjacent panels so that the clips anchor the two panels at each interlocking connection on the frame member.

21. A vertical wall structure according to claim 20, wherein said one leg portion is the first leg portion of the first edge portion and said other leg portion is the second leg portion of the second edge portion.

* * * * *